US009493982B2

(12) United States Patent
Utzon-Frank

(10) Patent No.: US 9,493,982 B2
(45) Date of Patent: Nov. 15, 2016

(54) LOUVER CONTROL MECHANISM

(71) Applicant: Kia Utzon-Frank, London (GB)

(72) Inventor: Kia Utzon-Frank, London (GB)

( * ) Notice: Subject to any disclaimer, the term of this patent is extended or adjusted under 35 U.S.C. 154(b) by 0 days.

(21) Appl. No.: 14/303,141

(22) Filed: Jun. 12, 2014

(65) Prior Publication Data

US 2015/0075727 A1 Mar. 19, 2015

(30) Foreign Application Priority Data

Jun. 14, 2013 (EP) ..... 13172129

(51) Int. Cl.

| | |
|---|---|
| ***E06B 9/36*** | (2006.01) |
| ***E06B 9/388*** | (2006.01) |
| ***E06B 7/08*** | (2006.01) |
| ***E06B 9/26*** | (2006.01) |

(52) U.S. Cl.

CPC ..... *E06B 9/388* (2013.01); *E06B 7/08* (2013.01); *E06B 9/26* (2013.01); *E06B 9/36* (2013.01); *E06B 9/364* (2013.01); *E06B 9/368* (2013.01)

(58) Field of Classification Search

CPC ..... E06B 9/36; E06B 9/307; E06B 9/368; E06B 9/364; E06B 9/384; E06B 9/388

USPC ..... 160/114–116, 130, 131, 167 V, 168.1 V, 160/174 R, 174 V, 176.1 V, 176.1 R, 180, 160/186, 349.1, 349.2, 352, 900

See application file for complete search history.

(56) References Cited

U.S. PATENT DOCUMENTS

| | | | | |
|---|---|---|---|---|
| 2,100,976 | A | 11/1937 | Norton | |
| 2,173,275 | A * | 9/1939 | Houmere | 160/89 |
| 2,188,575 | A * | 1/1940 | McLennan | 160/118 |
| 2,529,714 | A * | 11/1950 | Turkowski | 160/168.1 V |
| 2,611,426 | A * | 9/1952 | Elwin | 160/176.1 V |
| 2,766,820 | A | 10/1956 | Maiorino | |
| 2,774,418 | A * | 12/1956 | Turkowski | 160/118 |
| 3,299,943 | A | 1/1967 | Poe | |
| 4,657,061 | A * | 4/1987 | Meier | 160/176.1 V |
| 6,227,279 | B1 | 5/2001 | Belongia et al. | |
| 6,561,251 | B1 * | 5/2003 | Prosch | 160/115 |
| 2009/0071611 | A1 | 3/2009 | Osmond | |

FOREIGN PATENT DOCUMENTS

| | | |
|---|---|---|
| EP | 2540951 A1 | 7/2011 |
| JP | 2008261195 A | 10/2008 |

OTHER PUBLICATIONS

European Search Report in corresponding European Application No. 13172129.2, mailed Nov. 11, 2013.

* cited by examiner

*Primary Examiner* — Katherine Mitchell
*Assistant Examiner* — Jermey Ramsey
(74) *Attorney, Agent, or Firm* — Andrus Intellectual Property Law, LLP

(57) ABSTRACT

The present invention provides a mechanism for controlling the spacing between louvers, e.g. in a blind. The louvers are secured to a top rail and a bottom rail. The connections are at an angle to each other so that the louvers are naturally twisted. The louvers extend through slots in a comb 16 that can be moved up and down the louvers. The function of the comb is to alter the position of the twist as it is moved up and down the louvers, thereby opening and closing the blind.

19 Claims, 5 Drawing Sheets

LOUVER CONTROL MECHANISM

CROSS-REFRENCE TO RELATED APPLICATIONS

This application claims priority of European Patent Application No. EP 13172129.2, filed Jun. 14, 2013, the contents of which is incorporated herein by reference in its entirety.

TECHNICAL FIELD

The present invention relates to a novel mechanism that includes a number of louvers arranged in parallel whose orientation can be changed, e.g. to control the transmission of light, gas (such as air), liquids or other materials through it. It therefore finds particular application as a blind or shade for controlling the amount of light transmitted through a window or as a privacy screen, e.g. in hospitals, or as an arrangement for directing airflow. However, it is applications are not limited to these uses and numerous other uses are described below.

BACKGROUND ART

Venetian blinds are, of course, very well-known and can include horizontal or vertical louvers that can be opened and closed to alter the amount of light transmitted by the blind. In such blinds, the individual louvers can be turned or tilted so that the louvers overlap with each other (or at least abut one another) to close the blind or they can be turned or tilted parallel to the direction of light transmission to transmit light, for example into a room.

EP2540951 discloses a Venetian blind (10) that has several slats connected at each end to a motor-driven tilt mechanism, which acts to independently twist the slats between open and closed states.

U.S. Pat. No. 2,766,820 A discloses a window shade made up of a series of loops arranged in parallel to each other and together covering a window. Each loop has a rear section located on the windows-side of the shade and extending the full height of the window and a front section located on the room-side of shade. When the shade is closed, the rear sections of all the loops lie in substantially the same plane and light cannot be transmitted through the shade. However, a central slat is provided that can spread the front and back sections of the loops apart from each other to allow light to be transmitted through the shade into a room.

U.S. Pat. No. 6,227,279B discloses a Venetian type blind having pivoting/tilting slats or louvers. The louvers are segmented into a central section and outer sections and the blind includes a mechanism for pivoting and tilting the end sections of each louver relative to the middle section to control the amount of light admitted into a room.

JP2008261195A discloses a blind having vertical louvers. The louvers can be rotated about a vertical axis about an adjustable angle. The blind can be contracted and folded for storage when it is not used.

U.S. Pat. No. 3,299,943 A discloses a vertical louver window blind having a number of louvers, each of which is supported by a carriage that can be driven along a track, thereby extending the blind across a window or withdrawing it into one side. The carriages may be mounted on the upper frame of window. Each carriage may rotate the vertical louvers to adjust the light transmission of the blind.

US 2009071611 discloses a Venetian window blind made up of slats which are rotatable about their longitudinal axes to provide an open or closed blind. Each blind slat can carry part of a logo so that when the slats are rotated to close the blind, the different parts combine visually to provide the complete logo.

DESCRIPTION OF THE INVENTION

The present invention is defined in the accompanying claims.

Although the present invention will be described primarily in terms of blinds and screens, the structure of the present invention can have numerous applications, including those set out below. It will be appreciated that the invention is not limited to their application in the field of blinds and screens.

Generally speaking the present invention provides a structure comprising a number of flexible louvers arranged parallel to each other; the louvers are held at their two ends; to obtain the full effect of the present invention, the louvres are essentially taut, although not necessarily in tension. The structure includes a comb that has a number of slots through which the louvers pass. The comb can be moved along the lengths of the louvers. The slots in the comb have a different orientation as compared to the louvers at a first end of the louvers so that, by moving the comb towards the first end, the orientation of the louvers can be changed, e.g. they can be twisted or folded.

In one embodiment, the louvers are secured at one end (their first ends) at an angle relative to their second ends so that the louvers are twisted. The comb has slots that move the twist along the length of the louvers when the comb is moved from one end to the other. Therefore when the comb is at one end, the louvers have different orientations as compared to when the comb is at the other end of the louvers. For example, one end of the louvers can have an "open" orientation that provides a gap between the louvers while their other ends can have a "closed" configuration, in which the louvers abut against each other. For example, the comb may have slots aligned with the louvers at their top ends. In this case, when the comb is moved from the top end down towards the bottom ends, the louvers are, along most of their length, in their dosed state.

In another embodiment, the comb has two banks (or rows) of slots and each louver passes through slots in the two banks. Slots in one of the banks, which face the first ends of the louvers, may have the same orientation as the first ends of the louvers while the slots in the second bank, which face the second end of the louvers, may have the same orientation as the second ends of the louvers. In this way, the twist in the louvers occurs between the first and second banks rather than, in the case of a single-banked comb, between one end of the louvers and the comb.

The slots in the comb may simply twist the louvers as it passes along them, in which case the slots will generally be straight or gently curved. Alternatively, the slots can fold the louvers back on themselves, in which case the slots may be, for example, "U" "J" shaped in cross section. Of course other cross sections are possible.

The slots for all the louvers can be provided in a comb, e.g. in a single-banked or double-banked comb, that extends across the full width of the louvers or it is possible that the comb can be provided in separate sections, e.g. one section for each louver or for each group of adjacent louvers, so that the louvers can be adjusted individually or in groups or, if the comb encompasses all the louvers, all the louvers can be adjusted simultaneously. If more than one section is provided, the individual sections may be configured so that they can be coupled together (and so move in unison) and also uncoupled so that they can be moved individually for controlling different parts of the louvers separately.

The comb or combs can be moved manually or via a drive.

In one embodiment, the louvers are arranged in a straight row, but that is not necessary and they can be arranged in a curve or arranged in groups that are angled with respect to one another. In the latter case, the use of separate combs to orientate the louvers in each group may be preferable.

The mechanism may have more than one comb, for example two individually movable combs may be provided for each louver, in which case each louver will have three sections that can be separately orientated (one section extending from a first end of a louver to a first comb, the second section extending between the first and the second combs and the third between the second comb and the second end of the louver). More than two combs can be provided if desired.

The ends of the louvers and the slots in the comb may have fixed orientations; alternatively their orientations may be adjustable, for example by providing them in a rotatable mount. Individual mounts may be connected by gears so that all the mounts can be rotated together.

It is possible to couple different items to the combs, for example a shelf, in which case the height of the shelf can be adjusted by moving the comb. in this case, the mechanism may act merely as an adjustable height shelf support.

Mostly, the louvers will be secured at their ends to rails, e.g. a top rail and a bottom rail. The heights of the rails may be adjustable and indeed the distance between the rails may also be adjustable, in which case the lengths of the louvers should also be variable to maintain them in a taut state. This can be achieved, for example, if they are made of stretchable material or if they can be shortened, for example by securing one end to its rail via an adjustable buckle.

Although hitherto the louvers have been described as extending in the vertical direction, they can alternatively extend in a horizontal direction or indeed in any slanted direction desirable. However, the louvers will often be arranged vertically so that the weight of the comb does not cause the louvers to sag. Such sagging can, however, be avoided by supporting the weight of the comb from a rigid track.

The louvers may bear a graphic design on one face (or both faces) that is visible when the face is directed towards a viewer, i.e. when the louvers are "face-on" to the viewer as in the "closed" state described above. This is especially effective if the louvers each carry a part of a larger design. Obviously, the design could be pictorial (e.g. a corporate logo or a picture) or writing. Such an arrangement can be used in theatrical scenery with a scene depicted on one side of the louvres so that the scene is visible when the louvers are in a closed configuration but not visible when they are in an open configuration. Such an arrangement can be used in connection with a fixed scene arranged behind the louvres that is visible when the louvers are in an open configuration and not visible when they are in a closed configuration.

It will be appreciated that, by locating the comb part of the way along the louvers, the louvers will have different orientations either side of the comb. This can be used in a blind on a window facing a street to provide privacy and prevent people looking into the window; in this case, the ability to make one part of the blind in a closed state while another remains open is especially advantageous. In contrast to blinds presently provided, it is easy to arrange that the lower part of the blind can be closed while the upper part remains open.

As mentioned above, the present application can be used to form blinds or screens. However, the structure is more generally applicable, including use in:

- a blind
- a discretion screen, e.g. a screen around a hospital patient's bed to provide privacy
- a blind on a window facing a street to provide privacy and prevent people looking into the window
- a room divider or wall
- a display containing graphic or written material
- a shelving system,
- a lighting system for attenuating the light transmitted through it,
- a ventilation system for directing air in a number of different directions,
- a variable aperture screen for screening objects of different sizes, for example for screening mussels of different sizes,
- a sunscreen,
- a facade, e.g. on housing,
- a shelving or display unit,
- theatre scenery capable of varying the depiction of a scene.

DESCRIPTION OF THE DRAWINGS

The present invention will now be described, by way of example only by reference to the accompanying drawings in which.

DETAILED DESCRIPTION OF THE INVENTION

Figure 2:
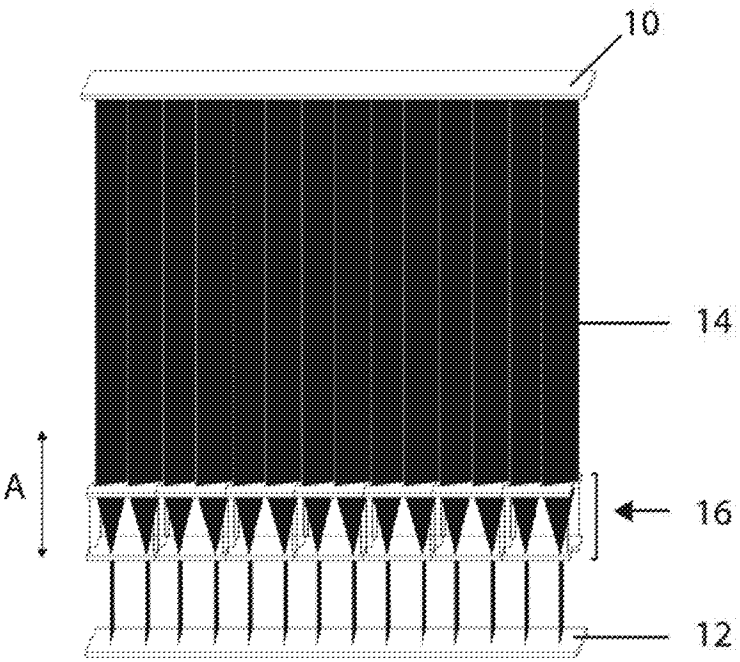
FIG. 2 shows the blind or screen of FIG. 1 in a "closed" state.
Figure 1:
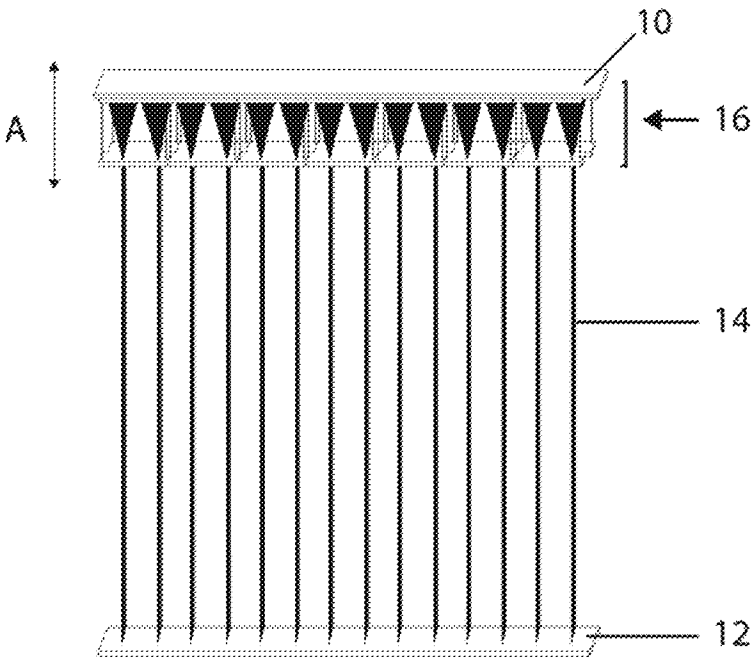
FIG. 1 shows a blind or screen in accordance with the present invention, in which the blind or screen is in an "open" state.

Referring initially to FIGS. 1 and 2, there is shown a blind or screen (which will be referred to in the following specific description as a "blind") in accordance with the present invention. The blind includes a top rail 10 and a bottom rail 12 and a number of louvers 14 extending vertically between them in a taut state. The louvers are made of flexible material so that they can twist but the specific material from which the louvers are made is not part present invention. A comb 16 can be moved vertically up and down the louvers in the direction of arrow A shown in FIG. 2.

Figure 3:
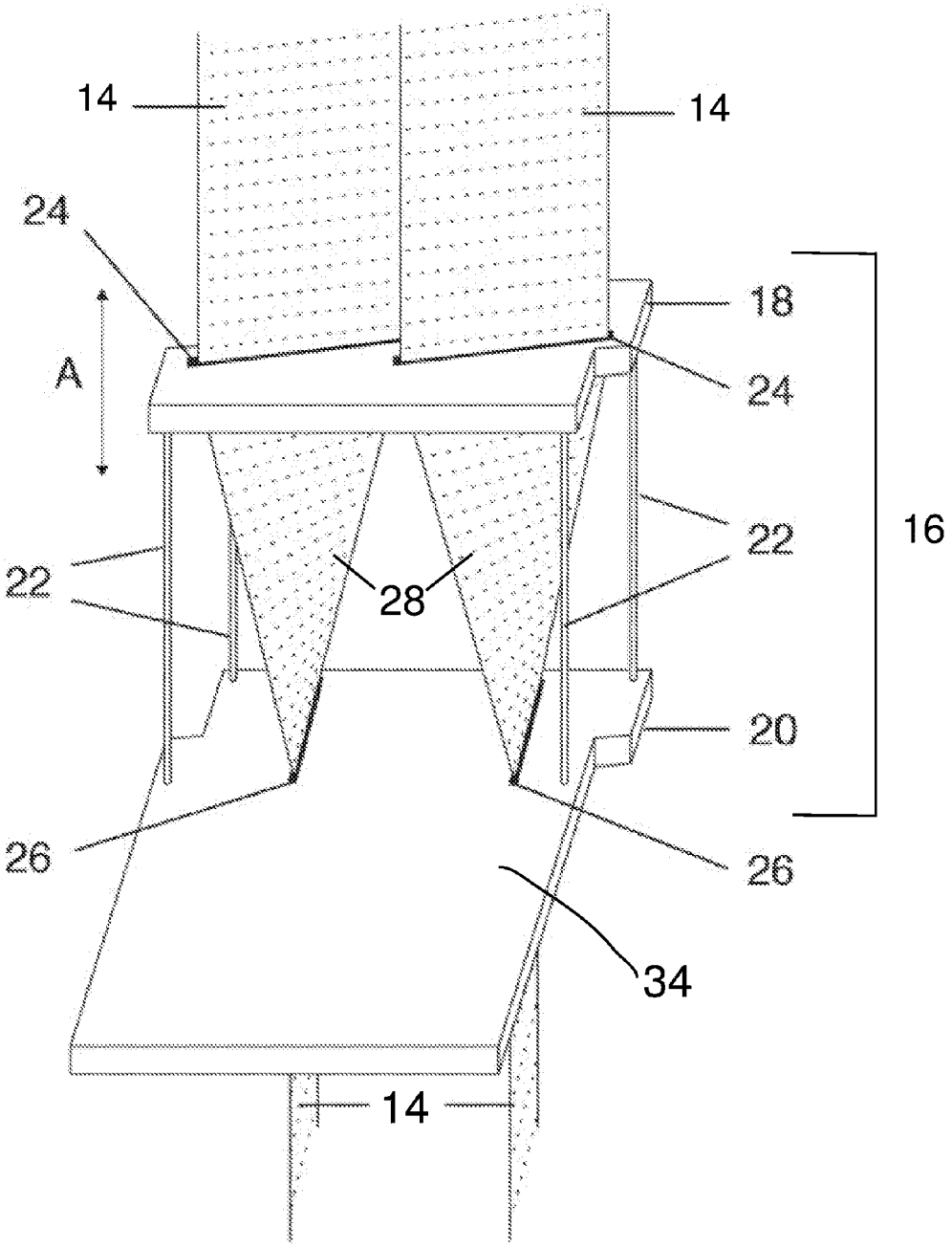
FIG. 3 shows a detail of a comb for use in the blind or screen of FIGS. 1 and 2.

FIG. 3 shows a more detailed view of the comb 16, which is made up of a top plate or bank 18 and a bottom plate or bank 20 that are connected by four rods 22. Slots 24 are provided in the top plate 18 and further slots 26 are provided in the bottom plate 20. These slots 24,26 have a width just greater than the width of the louvers 14 so that they can orient the louvers as the comb is moved along their length.

It is possible to couple different items to the comb 16, for example a shelf 34, in which case the height of the shelf 34 can be adjusted by moving the comb 16, In this case, the mechanism for controlling the spacing between louvers 14 may act merely as an adjustable height shelf support.

As can be seen, especially in FIG. 3, below the comb 16, the edges of the louvers 14 are facing the viewer, while the faces of louvers above the comb 16 are facing the viewer. Therefore, the blind above the comb 16 is closed while below the comb 16, it is open. The comb 16 is movable up-and-down the louvers and so, if positioned at the top of the louvers (as is the case in FIG. 1), the blind is open, while if positioned at the bottom of the louvers, it is closed; the blind shown in FIG. 2 is part of the way up the louvers and so is open at the bottom and closed at the top. The arrangement can thus be used for adjusting the levels of light that pass through the blind. It can also provide privacy when the blind is closed. If privacy is desired at the bottom part rather than at the top part, as shown in FIG. 2, the arrangement can be inverted.

Figure 4A:
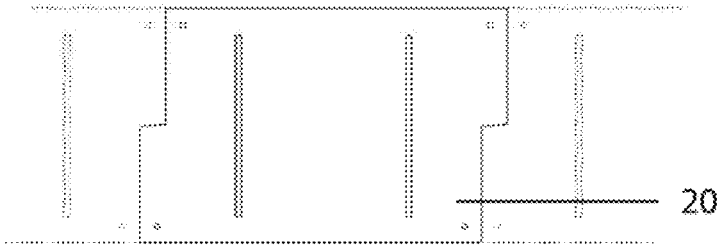
FIGS. 4A and 4B show parts of the top and bottom plate, respectively, of the comb of FIG. 3.
Figure 4B:
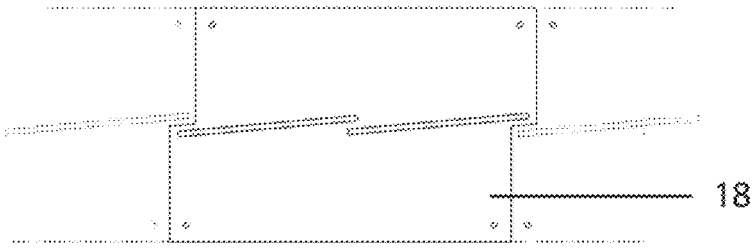

The louvers 14 are secured to the top rail 10 and, where they join the top rail, they are aligned with the length of the rail. In contrast the louvers are secured to the bottom rail at right angles (or some other angle) to the length of the bottom rail 12. The louvers are naturally twisted by this arrangement. FIGS. 4A and 4B show the top and bottom plates of the comb 16, respectively. The slots 24 in the top plate 18 are aligned with the louvers where they join the top rail 10 and likewise the slots 26 are aligned with the louvers at the bottom rail. The twists 28 in the louvers therefore lie between the two plates 18,20 of the comb 16. The function of the comb 14 is to alter the position of the twist 28 as the comb is moved up and down the louvers, thereby opening and closing the blind.

Figure 6:
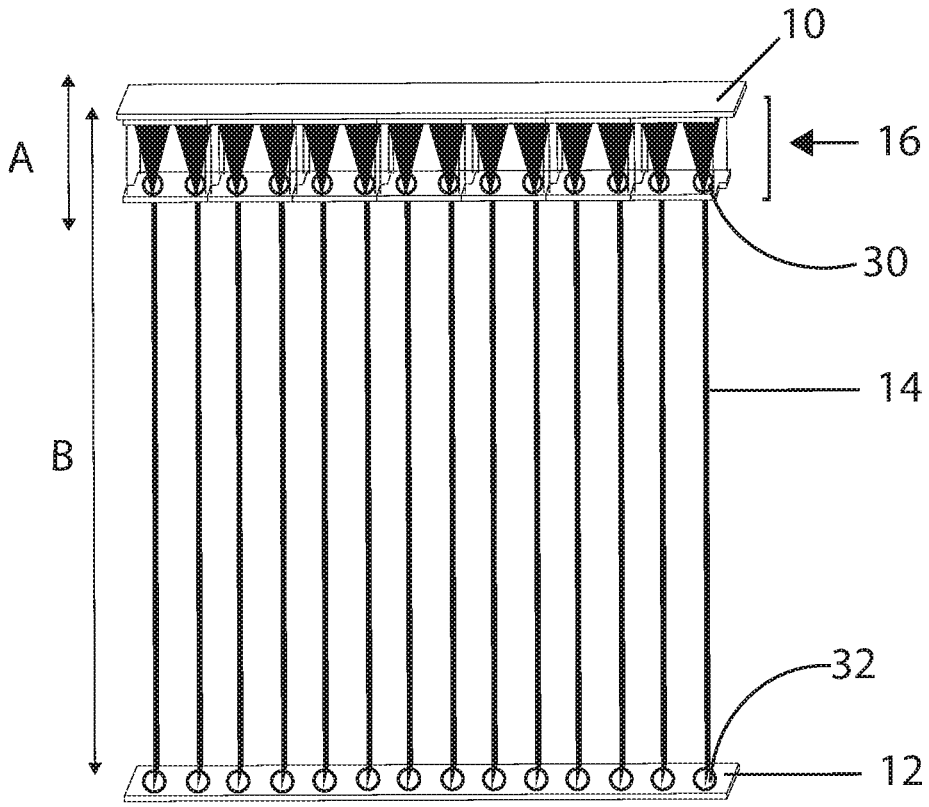
FIG. 6 shows a blind or screen in accordance with the present invention in which the louvers, slots, comb, and rails are adjustable.

As depicted in FIGS.1-4, the ends of the louvers 14 in the rails 10, 12 and the slots 24 in the comb 16 may have fixed orientations. Alternatively, the these orientations may be adjustable, for example as depicted in FIG. 6. The slots 24 are provided in rotatable mounts 30 in the comb 16. The ends of the louvers 14 are provided in rotatable mounts 32 in the rail 12. Individual mounts 30, 32 may be connected by gears so that all the mounts can be rotated together.

Mostly, the louvers 14 will be secured at their ends to rails, e.g. a top rail 10 and a bottom rail 12. The heights of the rails may be adjustable and indeed the indeed the distance between the rails may also be adjustable, as indicated by arrow B in FIG. 6. In an embodiment wherein the rails 10, 12 are adjustable, the lengths of the louvers should also be variable to maintain them in a taut state. This can be achieved, for example, if they are made of stretchable material or if they can be shortened, for example by securing one end to its rail via an adjustable buckle.

It is possible with the arrangement of FIGS. 1 to 4, that the comb is made up of a single plate but such an arrangement will only locate the twist 28 to lie above or below the comb (depending on the orientation of the slots in the comb). Such an arrangement either does not fully open the blind below the comb (if the twist is located below the twist) or does not fully close the blind above the comb (if the twist is located above the twist). Therefore the arrangement of the two plates, which confines the twist 28 to lie between the plates, is advantageous.

Where they join the top rail 10, the louvers overlap to shut out as much light as possible.

The plates are segmented as shown in FIG. 3 and 4 and are provided with holes 30 for securing a connector, e.g. a bracket (not shown) to connect a number of segments together to provide a blind of the desired width. Alternatively the sections are not connected together, in which case individual louvers can be controlled by one of the sections of the comb, but at a cost of having to move each section individually.

Figure 5:
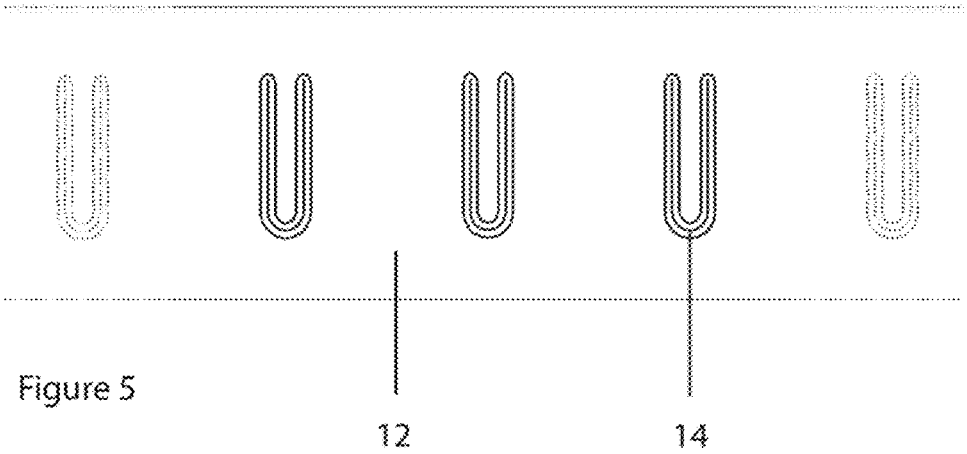
FIG. 5 shows a schematic view of the connection of a louver to a bottom rail in an alternative embodiment of the present invention.

In a different embodiment, the louvers are folded rather than twisted. The louvers in this case are the same as those shown in FIGS. 1 to 4, with the exception that, where they are connected to the bottom rail 12, the louvers 14 are folded back on themselves (folded double), as shown in FIG. 5. In this case, the comb has either flat slots that correspond to the connection of the louvers to the top rail 10 or U-shaped slots that correspond to the connection of the louvers to bottom rail 12 or slots having a shape that lies part of the way between these two extremes. If a double-banked comb is provided, the slots in the top plate 18 may have flat slots that correspond to the connection of the louvers to the top rail 10 while the bottom plate 20 may have U-shaped slots that correspond to the connection of the louvers to bottom rail 12, shown in FIG. 5.

Although the comb has been described as being solid with slots provided in them, the only requirement is that they have slots in them and otherwise they can be made of any desired material, e.g. wire.

The invention claimed is:

1. A mechanism comprising:

a first rail and a second rail;

two or more flexible louvers configured to lie generally parallel to each other and each having a first end secured at a first orientation to the first rail and a second end secured at a second orientation to the second rail, the first orientation different from the second orientation; and at least one comb comprising at least one slot that is shaped to hold at least one louver of the two or more flexible louvers in it, which comb is capable of travelling along the length of said louver, wherein the at least one slot has an orientation to said louver different from the orientation of at least one of the louver first end and the louver second end, whereby moving the comb along said louver alters a configuration of said louver.

2. The mechanism as claimed in claim 1, wherein the at least one comb includes a plurality of slots each slot holding a louver of the two or more flexible louvers.

3. the mechanism as claimed in claim 1, wherein the at least one comb comprises a first bank of slots comprising the at least one slot, and the at least one comb comprises a second bank of slots, the first bank of slots being spaced apart from the second bank of slots along a length of the louvers so that each louver of the two or more flexible louvers passes through a slot in each bank of the first and second banks of slots.

4. The mechanism as claimed in claim 3, wherein:

the slots of the first bank of slots nearer the first ends of the louvers have an orientation corresponding to the orientation of the first ends of the louvers and the second slots of the second bank of slots comb nearer the second ends of the louvers have an orientation corresponding to the orientation of the second ends of the louvers.

5. The mechanism as claimed in claim 1, wherein, at their first ends, the louvers overlap or abut against each other.

6. The mechanism as claimed in claim 1, wherein the orientation of each slot in the at least one comb can be adjusted.

7. The mechanism as claimed in claim 1, wherein the at least one slot has a folded configuration capable of folding the louver back on itself.

8. The mechanism as claimed in claim 1, wherein the at least one slot is straight.

9. The mechanism as claimed in claim 1, wherein the at least one comb is formed in at least two sections, each section including at least one slot whereby the configuration of the louvers can be altered one at a time or in groups.

10. The mechanism as claimed in claim 1, wherein the at least one comb includes a shelf.

11. The mechanism as claimed in claim 1, wherein the first rail is a top rail and the second rail is a bottom rail between which each louver is configured to extend.

12. The mechanism as claimed in claim 11, wherein at least one of the top rail and the bottom rail is of variable height.

13. The mechanism as claimed in claim 1 wherein the mechanism is configured as at least one of:

a blind;

a discretion screen;

a blind on a window facing a street to provide privacy and prevent people looking into the window;

a room divider or wall;

a display containing graphic or written material;

a shelving system;

a lighting system for attenuating the light transmitted through it;

a ventilation system for directing air in a number of different directions;

a variable aperture screen for screening objects of different sizes;

a sunscreen;

a facade;

a shelving or display unit; and theatre scenery capable of varying the depiction of a scene.

14. The mechanism as claimed in claim 1, wherein the second end of each louver is at an orientation that is a right angle to the first end of each louver.

15. The mechanism as claimed in claim 1 wherein an orientation of the at least one of a first and a second end of each louver is adjustable.

16. The mechanism as claimed in claim 15 wherein the orientation of at least one slot in the at least one comb is adjustable.

17. The mechanism as claimed in claim 16, wherein at least one of the orientation of at least one of a first end and a second end of each louver and the orientation of the slots in the comb is adjustable by rotation.

18. A mechanism comprising:

a first rail and a second rail;

a plurality of flexible louvers, each louver of the plurality secured at a first end to the first rail at a first angle, each louver of the plurality further secured at a second end to the second rail at a second angle, the first angle different from the second angle, creating a twist in each louver; and a comb comprising a first plate with a first plurality of slots through the first plate, each slot of the first plurality of slots corresponding to a louver of the plurality of louvers and receives said corresponding louver therethrough, the comb being translatable along the plurality of flexible louvers such that the twist in each louver is maintained between the first plate and the second rail.

19. The mechanism of claim 18, further comprising:

wherein the comb further comprises a second plate with a second plurality of slots through the second plate, the second plate spaced apart from the first plate, each a slot of the second plurality of slots corresponding to a louver of the plurality of louvers and receives said corresponding louver therethrough;

wherein an angle of the slots of the first plurality of slots match the first angle and an angle of the slots of the second plurality of slots match the second angle, and the twist in each louver is maintained between the first plate and the second plate, and translation of the comb along the plurality of flexible louvers moves a position of the respective twists along the flexible louvers.

* * * * *